United States Patent [19]

Kunkel

[11] 4,419,141

[45] Dec. 6, 1983

[54] CLEANING LABYRINTHINE SYSTEM WITH FOAMED SOLVENT AND PULSED GAS

[75] Inventor: Arden L. Kunkel, Tacoma, Wash.

[73] Assignee: Weyerhaeuser Company, Tacoma, Wash.

[21] Appl. No.: 365,121

[22] Filed: Apr. 5, 1982

[51] Int. Cl.[3] ..... B08B 9/00

[52] U.S. Cl. ..... 134/22.12; 134/22.14; 134/36

[58] Field of Search ..... 134/22.18, 22.19, 22.14, 134/22.12, 36

[56] References Cited

U.S. PATENT DOCUMENTS

| | | | |
|---|---|---|---|
| 2,695,246 | 11/1954 | Jurgensen | 117/46 |
| 2,734,224 | 2/1956 | Winstead | 18/12 |
| 3,037,887 | 6/1962 | Brenner | 134/22.19 X |
| 3,081,069 | 3/1963 | Oakes | 259/8 |
| 3,381,336 | 5/1968 | Wells | 18/8 |
| 3,436,262 | 4/1969 | Crowe | 134/22.19 X |
| 3,490,948 | 1/1970 | Farison | 134/36 |
| 3,615,817 | 10/1971 | Jordan | 134/22.19 X |
| 3,637,021 | 1/1972 | Hutchison | 134/36 X |
| 3,757,806 | 9/1973 | Bhaskar | 134/36 X |
| 3,874,926 | 4/1975 | Horne | 134/36 X |
| 3,895,984 | 7/1975 | Cone | 156/79 |
| 3,905,329 | 9/1975 | Cone | 118/410 |
| 3,905,921 | 9/1975 | Cone | 260/2.5 F |
| 3,938,467 | 2/1976 | Radowicz | 118/2 |
| 3,965,860 | 6/1976 | Cone | 118/612 |
| 4,170,489 | 10/1979 | Magnus | 134/22.12 |
| 4,223,633 | 9/1980 | Alrensleben | 118/203 |
| 4,238,244 | 12/1980 | Banks | 134/22.18 |
| 4,361,282 | 11/1982 | DiVito | 134/22.12 X |

*Primary Examiner*—Sidney Marantz

*Attorney, Agent, or Firm*—Weyerhaeuser Company

[57] ABSTRACT

A labyrinthine channel system which may contain parallel channels and dead-end zones is cleaned by flushing with a liquid solvent containing dispersed bubbles of a suspended gas. The gas is in the ratio of at least one volume of gas for each three volumes of liquid. Preferably the ratio of gas to liquid is 1:1 or greater. The liquid is preferably the continuous phase. By injecting pulses of additional gas into the dispersion, even greater effectiveness is achieved. The system is particularly useful in cleaning equipment containing high viscosity substances, such as adhesives.

10 Claims, 3 Drawing Figures

CLEANING LABYRINTHINE SYSTEM WITH FOAMED SOLVENT AND PULSED GAS

BACKGROUND OF THE INVENTION

The present invention is a method for cleaning a substance having the nature of a viscous liquid from a labyrinthine channel system which may contain parallel channels and dead-end zones. The method is particularly well adapted for cleaning automatic adhesive extrusion equipment between periods of use.

Systems which extrude a coating or adhesive onto a substrate materail are well known in the art. As one example, U.S. Pat. No. 4,223,633 to Alvensleben et al. shows an extrusion head for application of an adhesive to corrugated medium. Radowicz, in U.S. Pat. No. 3,938,467 shows another system for continuously mixing and applying an adhesive for wood gluing.

All of these systems must periodically be shut down and cleaned. It is normally impractical to mechanically disassemble all of the equipment used in application systems of the general type just mentioned. Cleaning is normally accomplished by flushing a solvent through the part of the system from which it is desired to remove the contained substance. An example of this is found in the aforementioned patent to Radowicz. Water is the solvent of preference but an organic solvent may be necessary when the contained substance is not water tolerant. If the viscosity of the substance being applied by the system is quite low, cleanup with a solvent such as water is usually very satisfactory. Unfortunately, substances such as adhesives which might be applied by such a system usually have relatively high viscosities or else have rheological properties which make them similar to high viscosity liquids. One example that can be cited is the application foamed phenolic resin adhesives in the continuous manufacture of plywood. A system of this type exemplified in one of the following U.S. patents to Cone and Steinberg: U.S. Pat. Nos. 3,895,984, 3,905,329, and 3,965,860. A satisfactory adhesive for use in these systems is shown by Cone and Steinberg in U.S. Pat. No. 3,905,921.

In the above noted adhesive application systems, a formulated phenolic resin mixture is foamed with air and applied through an extrusion head to wood veneer moving on a conveyor belt beneath the head. The foamer may be of the type disclosed in one of the above patents to Cone et al. or it may a type similar to those shown in patents to Jurgensen, Jr. et al. U.S. Pat. No. 2,695,246 or Oakes U.S. Pat. No. 3,081,069.

The extrusion heads may be of the type shown in the above Cone et al. patents or they may have a flow distribution system similar to those shown in the U.S. patents to Winstead U.S. Pat. No. 2,734,224 or Wells U.S. Pat. No. 3,381,336. In the latter cases the incoming fluid is divided in a series of repeatedly bifurcating channels to ensure even distribution to each of the application nozzles.

Unfortunately, adequate cleanup is not necessarily obtained in systems of the above type by simply flushing them with a liquid solvent. As an example, in extrusion heads of the types shown by Wells or Winstead the cleanup liquid may preferentially follow one series of channels leaving untouched the viscous substance in a series of parallel channels. The same is true is areas such as pumps or foamers where blind or dead-end channels occur. Surprisingly, even with the high degree of turbulence existing within a centrifugal pump, it has been found that in some designs a dead zone exists adjacent to the area where the shaft passes into the packing gland.

The present invention overcomes the problems experienced in the prior art in cleanup of systems where parallel channels or dead zones exist and it increases the efficiency of cleaning simpler systems. It is particularly useful for the cleanup of any equipment of complex internal configuration.

SUMMARY OF THE INVENTION

The present invention is a method of cleaning a viscous substance from the interior portions of a labyrinthine channel system. It comprises flushing the system with a liquid solvent for the viscous substance. The solvent contains essentially uniformly dispersed discrete bubbles of a suspended gas. The gas should be present in the solvent in a ratio of a least one volume of gas for each three volumes of liquid solvent. Preferably, the gas to liquid ratio will fall in the range of 1:1 to 5:1. The method has been found to work satisfactorily when the ratio of gas to liquid is as high as 10:1. The gas should preferably be present as bubbles within a continuous liquid phase. The method has been found to be less satisfactory when the flushing is attempted using liquid droplets contained within a continuous gaseous phase unless this is a situation which occurs intermittently with the use of a flushing medium in which the liquid phase is continuous. It has been found useful in some circumstances to inject pulses of additional gas into the system on a regular basis in order to achieve additional turbulence and more effective cleaning. During these pulses the gas may become the continuous phase. However, the pulse length during which additional gas is injected should not exceed 50% of the total cycle time between the gas pulses. Where the viscous substance contained within the system is water compatible, the solvent will normally be water and the gas entrained within the solvent can most conveniently be air. Other liquids and gases may be more satisfactory for certain materials.

It is an object of the present invention to provide a method for effectively cleaning a viscous substance from a complex or labyrinthine channel system.

It is another object to provide a method for cleaning an adhesive from an applicator system.

It is a further object of the invention to provide a method for cleaning a viscous substance contained within a geometrically complex system which contains dead pockets and parallel channels.

These and many other objects will become readily apparent upon reading the detailed description of the invention in conjunction with the attached drawings.

DESCRIPTION OF THE PREFERRED EMBODIMENTS

The present invention is being exemplified by reference to a system for applying a foamed adhesive to wood veneers during the continuous manufacture of plywood. It will be apparent to those skilled in the art that the following description is exemplary only and that the usefulness of the invention is not to be limited to the system about to be described.

A continuous plywood system consists of a main conveyor line carrying end to end sheets of veneer. Adhesive is applied to the upper surface of these sheets as they pass beneath an applicator head. Additional sheets of veneer and adhesive are added until the desired ultimate construction is attained. The assembled units are then sent to a hot press where the veneer sheets are bonded into panels of plywood. While the adhesive applied to the veneer need not necessarily be foamed, a system using the foamed adhesive has been chosen as exemplary because of the particular difficulties encountered in flushing it during periods of non-use. This is apparently caused by the particular nature of the foam which is intermediate in rheological properties between a liquid and a solid.

Figure 1:
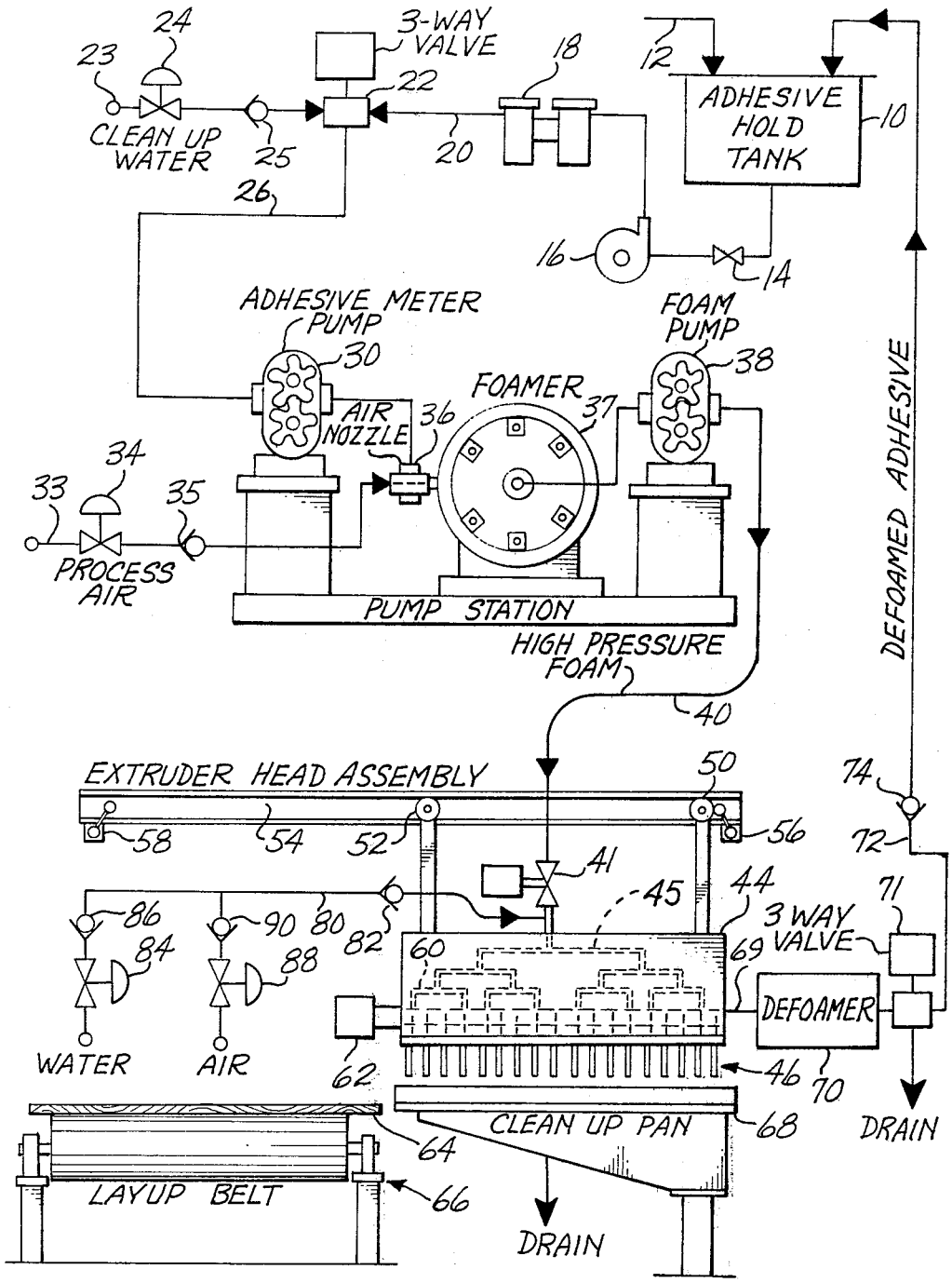
FIG. 1 is a representation of a system for applying a foamed adhesive during the continuous manufacture of plywood.

Referring now to FIG. 1, an adhesive hold tank 10 receives formulated adhesive 12 from a mixing area. This flows through a valve 14 into a pump 16 where it is forced through strainers 18 into a delivery line 20. The delivery line enters a three-way valve 22 where it exits through a line 26 to a metering pump 30. Also entering three-way valve 22 is a water line 23 through which the flow is controlled by valve 24 and backflow prevented by check valve 25. Adhesive from the metering pump enters a foamer 37 through a nozzle portion 36. Air is introduced into the system at this point through line 33, valve 34, and check-valve 35. The foamer 37 mechanically produces a stiff froth of air within the phenolic resin adhesive. Typically, the adhesive at this point will contain approximately five volumes of air for each volume of liquid. This is measured through a foam pump 38, which also supplies backpressure on the system. The foam is delivered through line 40 and valve 41 to an extrusion head 44. It is extruded from the head through a series of internal bifurcating channels 45 and nozzles 46. The head is suspended by rollers 50, 52 from a rail 54. In operating position the head would be to the left of the position shown in the drawing where it would be suspended over moving veneer 64 on a layup line 66. Limit switch 56 determines when the head is in the proper position for cleanup while limit switch 58 indicates the proper position for operation.

The head contains an internal slide valve 60 operated by air cylinder 62 which directs the adhesive either to the nozzles 46 or through line 69 to a defoamer 70. In the drawing the extrusion head is shown suspended over a pan 68 where it is in position for cleanup. When adhesive is diverted through defoamer 70 it passes through a three-way valve 71, line 72, and check-valve 74 back to the hold tank 10. During some cleanup cycles the three-way valve 71 may be shifted to divert the output from the defoamer to a drain or to a holding tank where the cleanup liquid can be used for other purposes.

Entering the adhesive system downstream from valve 41 is a line 80. This carries water which flows through valve 84 and check-valve 86 and air which enters through valve 88 and check-valve 90. The mixture of water and air passes through another check-valve 82 which prevents any back flow from the extrusion head.

Figure 2:
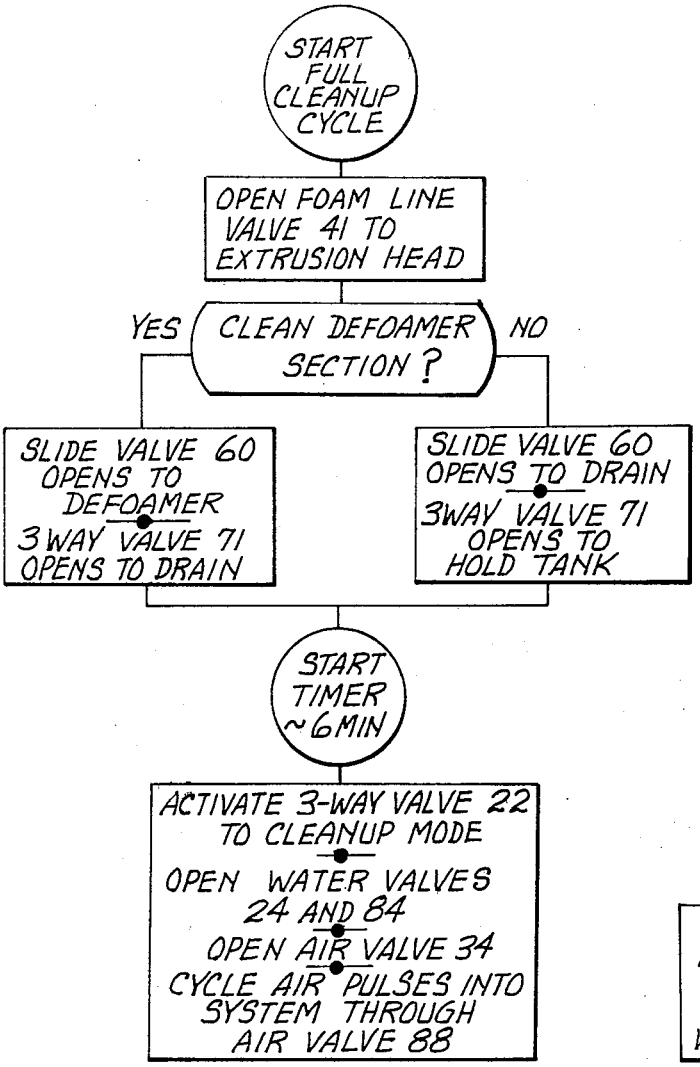
FIG. 2 is a block diagram showing the sequence of events which occur during a total cleanup of the system shown in FIG. 1.

One of several modes of cleanup may be used with this adhesive system. A full cycle will include at least the adhesive pumps and foamer, the high pressure foam line and the extrusion head. Alternatively, the defoamer may also be included if desired. The sequence of operations is shown in FIG. 2.

When a signal is given to the logic system which operates the controls to start a full cleanup cycle, the extrusion head must be in position against limit switch 56 which indicates that it is properly located over cleanup pan 68. At this time valve 41 on the foam line will be open to the extrusion head and the three-way valve 22 will be opened to receive cleanup water rather than adhesive. If it is desired to clean the defoamer section, slide valve 60 will open so that flow from the extrusion head will go to the defoamer rather than through the nozzles 46. It is presumed that during at least a portion of this cycle the nozzles will also be cleaned. Three-way valve 71 will in this case be opened to the drain rather than to the adhesive hold tank.

In the alternative mode, where it is not necessary to clean the defoamer, slide valve 60 will be open so that the clean-up liquid is directed through nozzles 46 to drain pan 68. Three-way valve 71 will remain in a position where it would be returning recycled adhesive to the hold tank.

When the above valves are properly in position, a timer will start which activates the following sequence. This will run for a period of about 6 minutes. During this time a total of approximately 80 gal of flushing water will pass through the system. The effluent water to the drain can be treated to make it environmentally acceptable or can be recycled to a hold tank for use in subsequent cleanup operations. Alternatively, all or a portion of it can be used for makeup of adhesive. After the timer has begun and three-way valve 22 has been shifted to the cleanup mode, water valves 24 and 84 will open to allow water to enter the system. Additionally, air valves 34 and 88 will be opened. The adhesive metering pump 30 in the system being described will normally deliver from $\frac{3}{4}$ gal to $1\frac{1}{2}$ gal of liquid per minute into the system. Air will continue to be supplied through line 33 at a ratio of approximately five volumes of air for each volume of water. Both pumps and the foamer will continue to run during this phase of the operation. Approximately 6–12 gal of water per minute will enter at the extrusion head immediately below valve 41. Air entering through valve 88 will be pulsed. Valve 88 is controlled by a timer, not shown, which regulates cycle time. The volume required will be varied and depends somewhat on the nature of the system and the substance contained within it. These air pulses are made at regular intervals and may comprise up to 50 percent of the cycle time between adjacent pulses. Sufficient air may be introduced during the pulsing time so that the system is inverted from an air-in-liquid suspension to a liquid-in-air suspension. This is not essential, however. These additional blasts of air have been found to be very useful in eliminating the problem of some channels carrying all the flushing medium while others remain filled with the viscous adhesive and are not cleaned. In a preferred mode of operation, additional air is pulsed into the system through valve 88 for three seconds out of a total 20 second cycle.

Figure 3:
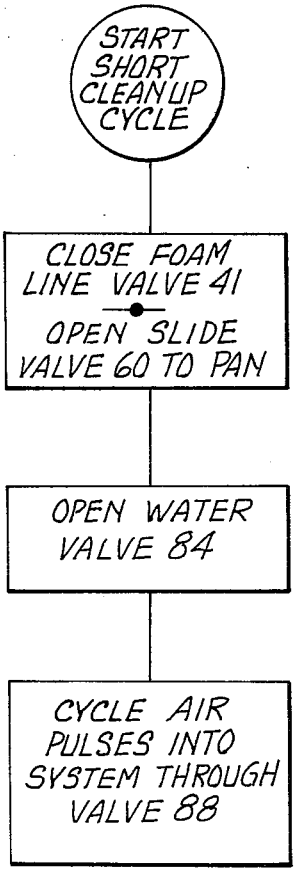
FIG. 3 is a block diagram showing the sequence of events which occur only when the extrusion head of FIG. 1 is to be cleaned.

Occasionally, it will not be necessary to clean the entire system. Sometimes foreign material will become lodged in one of the nozzles and it is only necessary to clean the extrusion head. The sequence for this shorter cleanup cycle is shown in FIG. 3. When the head 44 is properly located over the pan 68, and the signal to begin the cycle is received, valve 41 in the high pressure foamed adhesive line will close and slide-valve 60 will be open so that flow will be through the nozzles 46 into cleanup pan 68. Water valve 84 will then open and water will be directed into the extrusion head through line 80. Valve 88 is pulsed as before to introduce air into the system in order to dislodge plugs of glue in the interior channels 45 of the extrusion head and in the extrusion nozzles.

It has surprisingly been found that the combination of discrete gas bubbles within a liquid cleaning solvent is far more effective than a liquid solvent alone in cleaning a viscous substance from a complex or labyrinthine channel system. The reasons for this are not fully understood. The advantages between the use of the system described and one using a plain liquid for the cleanup of a complex channel system have been dramatically demonstrated, however.

Having thus described our best known mode of practicing the invention it will be apparent to those skilled in the art that many modifications can be made in the apparatus and method without departing from the spirit of the invention. The scope of the invention is thus to be limited only as defined in the appended claims.

What is claimed is:

1. A method of cleaning a viscous substance from a labyrinthine channel system which comprises:

a. flushing the system with a liquid solvent for the substance, said solvent being a continuous phase containing discrete bubbles of a suspended gas in a ratio of at least one volume of gas for each three volumes of liquid, and b. injecting additional gas into the system in the form of regular discrete pulses during which pulse time the gaseous phase becomes the continuous phase.

2. The method of claim 1 in which the ratio of gas to liquid solvent is between 1:3 to 10:1.

3. The method of claim 1 in which the pulse duration is no more than 50% of the time interval between successive pulses.

4. The method of claim 3 in which the liquid solvent is water and the gas is air.

5. The method of claims 1 or 2 in which the liquid solvent is water and the gas is air.

6. In the method of cleaning an adhesive application system comprising adhesive pumps, a foamer and an extrusion head, said system containing parallel channels and dead end volumes, the improvement which comprises flushing the system with a liquid solvent for the adhesive, said solvent being a continuous phase containing discrete bubbles of a suspended gas in a ratio of at least one volume of gas for each three volumes of liquid, and further injecting additional gas into the system in the form of regular discrete pulses during which pulse time the gaseous phase becomes the continuous phase.

7. The method of claim 6 in which the ratio of gas to liquid solvent is between 1:3 and 10:1.

8. The method of claim 6 in which the adhesive is a foamed phenolic resin.

9. The method of claim 8 in which the liquid solvent is water and the gas is air.

10. The method of claims 6 or 9 in which the pulse duration is no more than 50% of the time interval between successive pulses.

* * * * *